US009857121B2

(12) United States Patent
Yang

(10) Patent No.: US 9,857,121 B2
(45) Date of Patent: Jan. 2, 2018

(54) ICE MAKER OF REFRIGERATOR AND MANUFACTURING METHOD FOR THE SAME

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 173 days.

(21) Appl. No.: 14/837,630

(22) Filed: Aug. 27, 2015

(65) Prior Publication Data

US 2016/0370090 A1 Dec. 22, 2016

(30) Foreign Application Priority Data

Jun. 18, 2015 (KR) ..... 10-2015-0086322

(51) Int. Cl.

| | |
|---|---|
| ***F25C 5/18*** | (2006.01) |
| ***F25D 17/06*** | (2006.01) |
| ***F25C 1/24*** | (2006.01) |
| ***F25C 5/08*** | (2006.01) |
| *F25C 5/00* | (2006.01) |
| *F25C 5/06* | (2006.01) |

(52) U.S. Cl.

CPC ..... *F25D 17/065* (2013.01); *F25C 1/24* (2013.01); *F25C 5/08* (2013.01); *F25C 5/182* (2013.01); *F25C 5/005* (2013.01); *F25C 5/06* (2013.01); *F25C 2305/022* (2013.01); *F25D 2317/061* (2013.01)

(58) Field of Classification Search

CPC ..... F25C 1/04; F25C 1/225; F25C 5/005
USPC ..... 62/340, 344
See application file for complete search history.

(56) References Cited

U.S. PATENT DOCUMENTS

| | | | |
|---|---|---|---|
| 2008/0034780 | A1 | 2/2008 | Lim et al. |
| 2011/0162406 | A1 | 7/2011 | Shin et al. |
| 2015/0316306 | A1 | 11/2015 | Ji et al. |

FOREIGN PATENT DOCUMENTS

| | | | |
|---|---|---|---|
| KR | 10-2008-0014598 | A | 2/2008 |
| KR | 10-1320767 | | 10/2013 |
| KR | 10-2014-0074795 | A | 6/2014 |

OTHER PUBLICATIONS

Extended European Search Report dated Nov. 16, 2016 issued in corresponding European Patent Application No. 15186850.2.

*Primary Examiner* — Melvin Jones

(57) ABSTRACT

An ice maker includes a cooling unit for generating cold air; a case defining a cooling space for receiving the cold air; an ice making assembly for making ice; and a bucket for receiving the ice. The ice making assembly includes an ice tray; and a cold air guiding unit for guiding the cold air to the lower side of the ice tray. A guide member of the guiding unit defines a flow channel, along which the cold air flows, between the guide member and the bottom surface of the tray. The guide member includes a first inclined section extending in a longitudinal direction of the ice tray for guiding the cold air to the bottom surface of the tray. An imaginary extension line of the first inclined section reaches between two of the ice making recesses adjacent to each other in the longitudinal direction of the ice tray.

18 Claims, 6 Drawing Sheets

ICE MAKER OF REFRIGERATOR AND MANUFACTURING METHOD FOR THE SAME

CROSS-REFERENCE TO RELATED APPLICATIONS

The present application claims priority to and the benefit of the Republic of Korea Patent Application Serial Number 10-2015-0086322, having a filing date of Jun. 18, 2015, filed in the Korean Intellectual Property Office, the disclosure of which is herein incorporated by reference in its entirety.

FIELD OF THE INVENTION

The present invention relates to an ice maker for refrigerators and a method for manufacturing the same.

BACKGROUND

A refrigerator unit is an apparatus intended to store food items at low temperatures. The refrigerator unit may store foods in a frozen or refrigerated state according to the type of food intended to be stored.

The interior of the refrigerator unit is cooled by cold air that is constantly supplied. The cold air is constantly generated through a heat exchanging operation with a refrigerant based on a refrigeration cycle. The cycle includes a process of compression-condensation-expansion-evaporation. The cold air supplied to the inside of the refrigerator unit is evenly transferred by convection to store food and drink items within the refrigerator unit at a desired temperature.

In general, a main body of the refrigerator unit has a rectangular, hexahedral shape which is open at a front surface. The front surface may provide access to a refrigeration chamber and a freezer chamber located within the body of the refrigerator unit. Further, hinged doors may be fitted to the front side of the refrigerator body in order to selectively open and/or close openings to the refrigeration chamber and the freezer chamber. In addition, a number of drawers, racks, shelves, storage boxes, and the like may be provided in the refrigeration chamber and the freezer chamber within the refrigerator unit that are configured for optimally storing various foods and items within a storage space inside the refrigerator unit.

Conventionally, refrigerator units were configured as a top mount type in which a freezer chamber is positioned above a refrigeration chamber. Recently, bottom freeze type refrigerator units position the freezer chamber below the refrigeration chamber to enhance user convenience. In the bottom freeze type refrigerator unit, the more frequently used refrigeration chamber is advantageously positioned at the top so that a user may conveniently access the chamber without bending over at the waist, as previously required by the top mount type refrigerator unit. The less frequently used freezer chamber is positioned at the bottom.

However, a bottom freeze type refrigerator unit may lose its design benefits when a user wants to access the lower freezer chamber on a more frequent basis. For example, prepared ice that is stored in the freezer chamber may be a popular item accessed frequently by a particular user. In a bottom freeze type refrigerator unit, since the freezer chamber is positioned below the refrigeration chamber, the user would have to bend over at the waist in order to open the freezer chamber door to access the ice.

In order to solve such a problem, bottom freeze type refrigerators may include a dispenser configured for dispensing ice that is provided in a refrigeration chamber door. In this case, the ice dispenser is also positioned in the upper portion of the refrigerator unit, and more specifically is located above the freezer chamber. In this case, an ice maker for generating ice may be provided in the refrigeration chamber door or in the interior of the refrigeration chamber.

The ice maker may include an ice making assembly having an ice tray for making ice (e.g., ice cubes) (hereinafter, referred to as an 'ice tray'), an ice bucket (hereinafter, referred to as a 'bucket') for storing the ice, and a transfer assembly for transferring the ice stored in the bucket to the dispenser.

The ice making assembly may include a heater. The heater may emit heat for purposes of separating the ice from the ice making assembly. Specifically, ice making recesses may be formed in an upper surface of the ice tray, and water stored in the recesses is frozen into ice. The heater may emit heat to slightly melt the ice, such that the ice can be easily separated from the ice making recesses However, the heat emitted by the heater interacts with cold air that is supplied to the ice tray, and a heat exchange between the heat and the cold air is performed, which reduces the cold air available for freezing water to ice. As a result, both the cooling efficiency and the ice separation efficiency are lowered.

In addition, exhaustion of limited energy resources and environmental pollution have become more serious issues, and correspondingly improvement of the cooling efficiency of refrigerator units has been continuously requested.

What is needed is an efficient way to make ice within a refrigerator unit.

SUMMARY

In view of the above, therefore, embodiments of the present invention provide an ice maker of a refrigerator unit that is capable of limiting the heat exchange between heat emitted by a heater and cold air used to make ice, thereby improving overall efficiency of an ice maker, and a manufacturing method of the same.

In accordance with one embodiment of the present invention, there is provided an ice maker for a refrigerator unit. The ice maker may include a cooling unit for generating cold air, a case mounted in a food storage space of the refrigerator unit and/or a door for shielding the food storage space. The case having defined therein a cooling space for receiving the cold air generated by the cooling unit, an ice making assembly in the cooling space for making ice using the cold air, and a bucket arranged at one side of the ice making assembly in the cooling space for receiving the ice separated from the ice making assembly. The ice making assembly includes an ice tray arranged in the cooling space, the ice tray having a plurality of ice making recesses formed in an upper surface thereof for making ice, and a guide unit arranged at a lower side of the ice tray for guiding the cold air supplied from the cooling unit to the lower side of the ice tray. The guide unit includes a guide member spaced apart downward from a bottom surface of the ice tray for defining a cold air flow channel, along which the cold air flows, between the guide member and the bottom surface of the ice tray. The guide member includes a first inclined section extending, while being inclined upward, in a longitudinal direction of the ice tray, and is configured for guiding the cold air to the bottom surface of the ice tray. An imaginary extension line of the first inclined section reaches between two of the ice making recesses that are adjacent to each other in the longitudinal direction of the ice tray.

Further in one embodiment, the guide member includes a second inclined section extending, while being inclined downward, from a highest point of the first inclined section in the longitudinal direction of the ice tray.

Also in one embodiment, the first inclined section includes at least two first inclined sections provided in the longitudinal direction of the ice tray. The number of the ice making recesses is at least four. An imaginary extension line of one of the at least two first inclined sections reaches between two of the at least four ice making recesses that are adjacent to each other. An imaginary extension line of another of the at least two first inclined sections reaches between other two of the at least four ice making recesses that are adjacent to each other.

Further in one embodiment, the ice making assembly includes a heater provided at the lower side of the ice tray. The heater is configured to be spatially separated from the guide unit, and is configured for emitting heat to separate the ice from the ice making recesses.

Also in one embodiment, the heater is provided along an edge of the ice tray, and the cold air flows along a central portion of the ice tray in the longitudinal direction of the ice tray.

Further in one embodiment, the heater is provided along an edge of the ice tray. The ice maker includes a first heat exchange prevention wall protruding downward from the bottom surface of the ice tray, while extending along the edge of the ice tray. The first heat exchange prevention wall is located more inwardly in relation to the ice tray than the heater, and the cold air flows inside the first heat exchange prevention wall.

Also in one embodiment, the ice maker further includes a pair of second heat exchange prevention walls protruding upward from an upper surface of the guide member, while extending along the edge of the ice tray, in the longitudinal direction of the ice tray. The second heat exchange prevention walls may be spaced apart from each other in a lateral direction of the ice tray.

Further in one embodiment, the heater is located outside the second heat exchange prevention walls, and the cold air flows between the second heat exchange prevention walls.

Also in one embodiment, the first heat exchange prevention wall is adjacent to the second heat exchange prevention walls. At least a portion of the first heat exchange prevention wall and at least a portion of each of the second heat exchange prevention walls overlap each other in the lateral direction of the ice tray.

In accordance with another embodiment of the present invention, a method of manufacturing an ice maker of a refrigerator unit includes: preparing a case; arranging a cooling unit for generating cold air; arranging an ice tray having a plurality of ice making recesses formed in an upper surface thereof for making ice; and arranging a cold air guiding unit for guiding the cold air generated by the cooling unit to a lower side of the ice tray. The cold air guiding unit includes a guide member spaced apart downward from a bottom surface of the ice tray for defining a cold air flow channel, along which the cold air flows, between the guide member and the bottom surface of the ice tray. The guide member includes a first inclined section extending, while being inclined, upward in a longitudinal direction of the ice tray for guiding the cold air to the bottom surface of the ice tray. An imaginary extension line of the first inclined section reaches between two of the ice making recesses that are adjacent to each other in the longitudinal direction of the ice tray.

In accordance with another embodiment, a refrigerator is disclosed and includes a freezer chamber located within a main body of the refrigerator, and a refrigeration chamber located within the main body of the refrigerator. The refrigerator includes an ice maker. The ice maker may include a cooling unit for generating cold air, a case mounted in a food storage space of the refrigerator unit and/or a door for shielding the food storage space. The case having defined therein a cooling space for receiving the cold air generated by the cooling unit, an ice making assembly in the cooling space for making ice using the cold air, and a bucket arranged at one side of the ice making assembly in the cooling space for receiving the ice separated from the ice making assembly. The ice making assembly includes an ice tray arranged in the cooling space, the ice tray having a plurality of ice making recesses formed in an upper surface thereof for making ice; and a cold air guiding unit arranged at a lower side of the ice tray for guiding the cold air supplied from the cooling unit to the lower side of the ice tray. The cold air guiding unit includes a guide member spaced apart downward from a bottom surface of the ice tray for defining a cold air flow channel, along which the cold air flows, between the guide member and the bottom surface of the ice tray. The guide member includes a first inclined section extending, while being inclined upward, in a longitudinal direction of the ice tray, and is configured for guiding the cold air to the bottom surface of the ice tray. An imaginary extension line of the first inclined section reaches between two of the ice making recesses that are adjacent to each other in the longitudinal direction of the ice tray

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTION

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, functions, constituents, procedures, and components have not been described in detail so as not to unnecessarily obscure aspects and/or features of the present disclosure.

Figure 1:
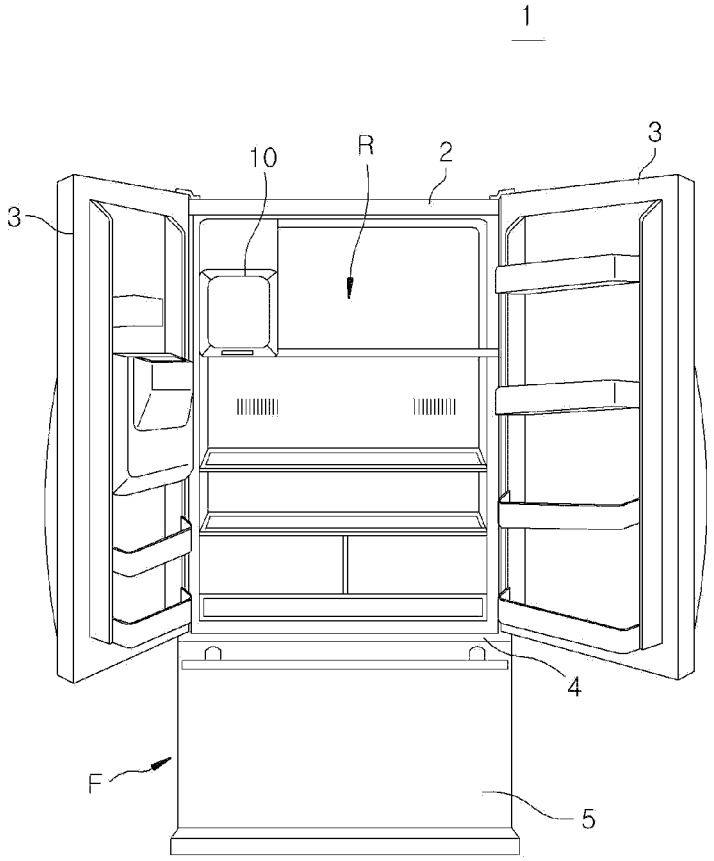
FIG. 1 is a diagram illustrating a refrigerator unit including an ice maker, in accordance with one embodiment of the present invention.
Figure 2:
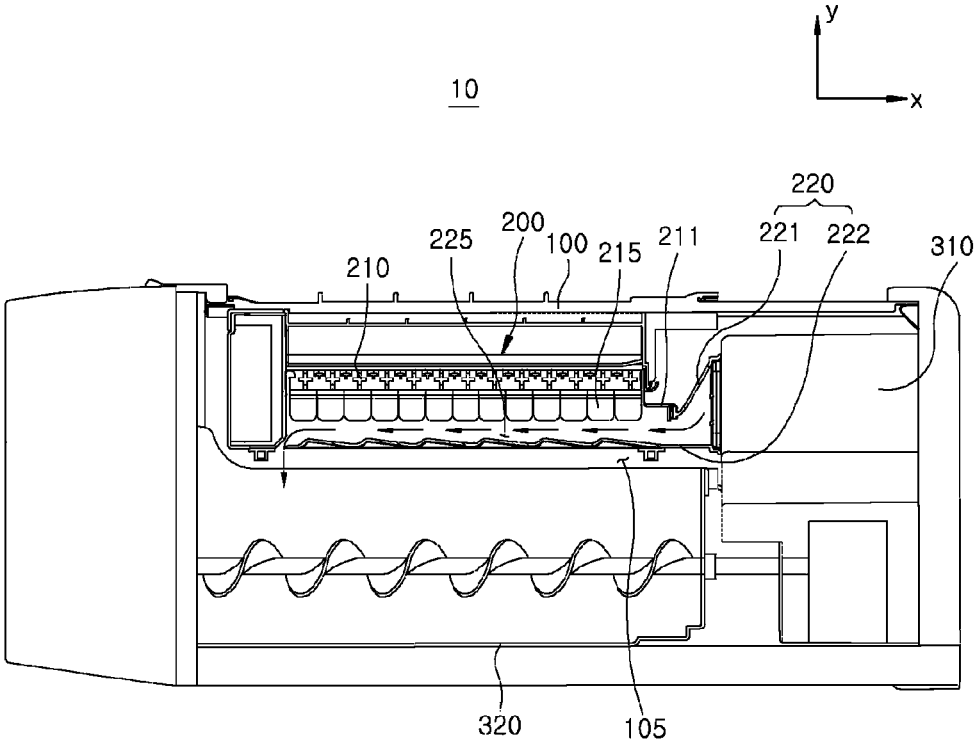
FIG. 2 is a side cross-sectional view showing the ice maker of FIG. 1, in accordance with one embodiment of the present invention.
Figure 3:
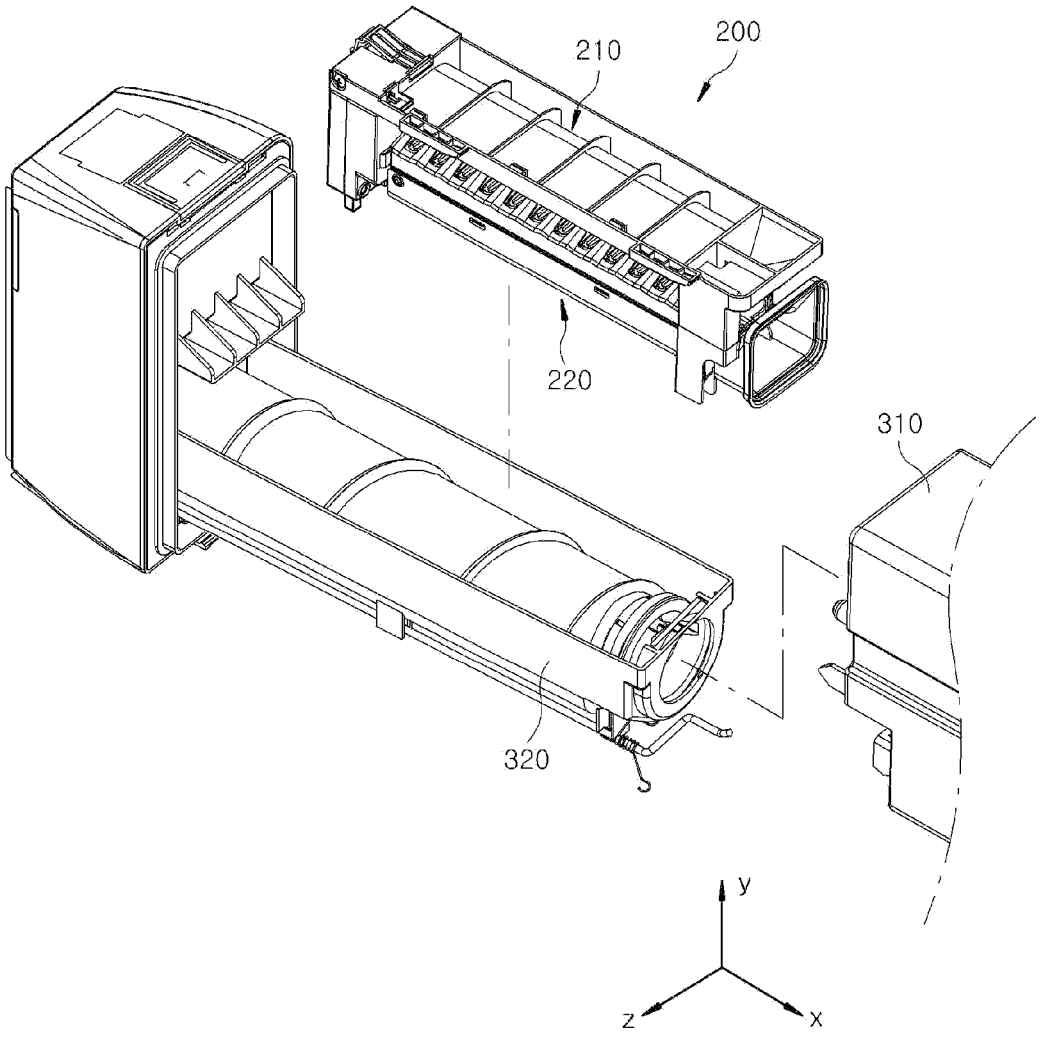
FIG. 3 is an exploded perspective view showing the ice maker of FIG. 1, in accordance with one embodiment of the present disclosure.

FIG. 1 is a view illustrating a refrigerator unit including an ice maker 10, in accordance with one embodiment of the present invention. FIG. 2 is a side cross-sectional view showing the ice maker 10 of FIG. 1, in accordance with one embodiment of the present invention. FIG. 3 is an exploded perspective view showing the ice maker 10 of FIG. 1, in accordance with one embodiment of the present disclosure.

As shown in FIGS. 1-3, an ice maker 10 for a refrigerator unit 1 may include a case 100, a cooling unit (not shown), an ice making assembly 200, and a bucket 320 of embodiments of the present invention.

More particularly, as shown in FIG. 1, the refrigerator unit 1 may include a main body 2 having therein a food storage space, and is configured for forming an external appearance or exterior. A barrier 4 is configured for dividing the food storage space formed in the interior cavity of the main body 2, used for storing food and drink contained therein, into a refrigeration chamber (R) at the top thereof, and a freezer chamber (F) at the bottom thereof. One or more doors may be configured to selectively isolate the interiors of the chambers from the surrounding environment. For example, refrigeration chamber doors 3 are provided at both front edges of the main body 2 and are configured through rotation thereof for selectively shielding the refrigeration chamber R through contact with edges/rims to sides of the main body 2. A freezer chamber door 5 is configured for shielding a front opening of the freezer chamber (F).

In the present embodiment, although the ice maker 10 is illustrated as being provided at one side of an upper portion of the refrigerator chamber (R), the location is provided merely for illustration purposes only. Alternatively, the ice maker 10 may be installed in a different position within the interior of the refrigeration chamber (R), or at a different position such as the refrigeration chamber door 3, and the like.

The case 100 has defined therein a cooling space 105, to which cold air generated by the cooling unit is supplied. The ice making assembly 200 may be arranged at an upper side and/or portion of the cooling space 105. The ice bucket 320 may be arranged at a lower side and/or portion of the ice making assembly 200.

The cooling unit generates cold air and supplies the generated cold air to the cooling space 105. The cooling unit may include a compressor, a condenser, an expansion valve, an evaporator, or the like which constitute a cooling and/or refrigeration cycle. For example, the cooling unit generates cold air by exchanging heat between a refrigerant and air. The cold air may be actively supplied to the ice tray 210 via the discharge duct 310 and a cold air guiding unit 220 by a blower, or the like.

The ice making assembly 200 includes an ice tray 210 which receives water, a cold air guiding unit 220 which guides the flow of cold air such that the cold air supplied from the cooling unit moves along a bottom surface of the ice tray 210, and a heater (not shown) which separates the ice made in the ice tray 210 from tray 210.

The ice tray 210 provides a space in which water supplied from a water supply pipe (not shown), or the like, is cooled into ice. The ice tray 210 may have a plurality of ice making recesses 215 formed at an upper side or surface thereof for receiving water. The ice making recesses 215 may have various shapes according to the shape of ice that is intended to be made, and the number of the ice making recesses 215 may be variously adjusted.

The ice tray 210 may be made from metals having high thermal conductivity. For example, the ice tray 210 may be made from aluminum. The higher the thermal conductivity of the ice tray 210, the greater the heat exchange rate of the water and cold air, which uses less cooling cycles to make ice. Therefore, depending on the metal used, the ice tray 210 may play a role of a heat exchanger. Further, although it is not shown, a cooling rib or the like may be installed at the bottom surface of the ice tray 210 to increase the area of contact with the cold air, also reducing the number of cooling cycles to make ice.

The cold air guiding unit 220 functions to guide the cold air supplied from the cooling unit to the bottom of the ice tray 210. The cold air guiding unit 220 may be connected to the discharge duct 310, which forms a passage through which the cold air circulates as it is being supplied from the cooling unit. The cold air guiding unit 220 may include guide members 221 and 222 that are each connected to at least one surface of the discharge duct 310. As shown, the cold air guiding unit 220 may include a first guide member 221 extending from an upper surface of the discharge duct 310, and a second guide member 222 extending from a lower surface of the discharge duct 310.

The first guide member 221 may be connected between the upper surface of the discharge duct 310 and a bracket 211 to which the ice tray 210 is mounted. The second guide member 222 may extend from the lower surface of the discharge duct 310, so as to be spaced apart from the bottom surface of the ice tray 210 by a predetermined distance. Thus, a cold air flow channel 225, configured for allowing the movement of cold air, may be formed between the bottom surface of the ice tray 210 and an upper surface of the second guide member 222.

The cold air guided by the guide members 221 and 222 may circulate towards and/or over the bottom surface of the ice tray 210. The cold air may exchange heat with the ice tray 210, such that the water contained in the ice making recesses 215 of the ice tray 210 may be frozen into ice.

The ice made in the above manner may be dropped into the ice bucket 320 arranged beneath the ice tray 210. For example, an additional rotation device may be provided such that the upper surface of the tray 210 may be turned towards the ice bucket 320 by rotation of the rotation device. Subsequently, the ice tray 210 may be twisted due to interference with a predetermined interference member (not shown) when the ice tray 210 is rotated more than a specific angle. The ice formed in the ice tray 210 may be dropped into the bucket 320 through twisting of the ice tray 210. Alternatively, an ejector provided at the ice tray 210 may drop the ice made in the ice making recesses 215 into the bucket 320 without rotation of the ice tray 210.

Figure 4:
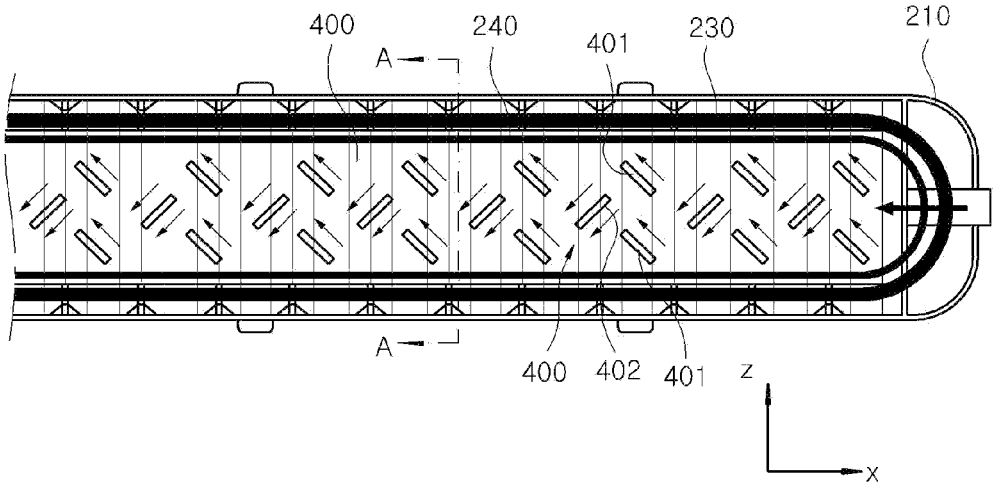
FIG. 4 is a bottom view showing an ice making assembly of the ice maker of FIG. 1, in accordance with one embodiment of the present disclosure.
Figure 5:
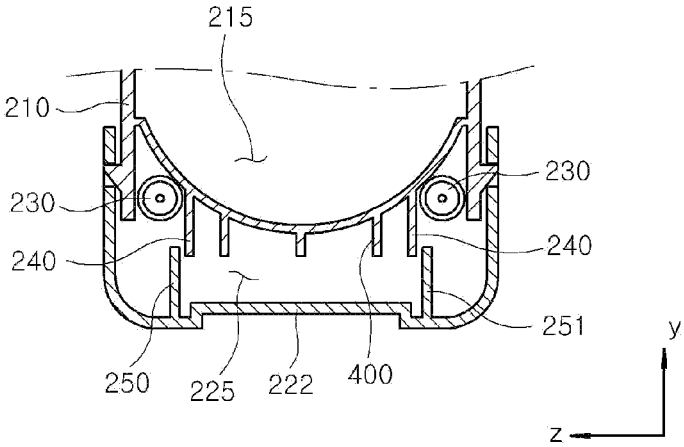
FIG. 5 is a cross-sectional view taken along line A-A of FIG. 4, in accordance with one embodiment of the present disclosure.

The heater may emit heat to the ice tray 210, such that the ice formed in the ice making recesses 215 can be easily separated from the ice making recesses 215. That is, the heater may emit heat to slightly melt the ice formed in the ice tray 210. Thereafter, the ice tray 210 may be rotated, or the ejector may be driven, such that the ice is dropped into the bucket 320. As shown in FIGS. 4 and 5, the heater may be provided at the bottom surface of the ice tray 210 while extending along the edge of the tray 210.

Meanwhile, conventionally, the heat emitted by the heater comes across and/or interacts with the cold air generated by the cooling unit, whereby heat exchange between the heat and the cold air occurs. As a result, overall efficiency of the ice maker 10 is considerably lowered. In embodiments of the present invention, however, the heater may be spatially separated from the cold air guiding unit 220. As a result, heat exchange between the heat emitted by the heater and the cold air generated by the cooling unit may be prevented.

Hereinafter, embodiments of the present invention will be described in more detail with reference to FIGS. 4 and 5. FIG. 4 is a bottom view showing the ice making assembly 200 of the ice maker 10 of FIG. 1, in accordance with one embodiment of the present disclosure. FIG. 5 is a cross-sectional view taken along line A-A of FIG. 4. For clarity, the cold air guiding unit 220 is not shown in FIG. 4.

For reference, a longitudinal direction of the ice tray 210 may mean an x-axis direction in FIGS. 4 and 5, indicating a direction in which the cold air flows, or a direction in which a longer side of the ice tray 210 extends. In addition, a lateral direction of the ice tray 210 may mean a z-axis direction in FIGS. 4 and 5, or a direction in which a shorter side of the ice tray 210 extends. Meanwhile, a y-axis direction may mean a vertical direction in FIGS. 4 and 5.

As shown, the heater 230 may be formed in a long band. The heater 230 may be provided at a lower side and/or portion of the ice tray 210. More specifically, the heater 230 may be provided at the lower side of the ice tray 210, while extending along the edge of the ice tray 210.

A first heat exchange prevention wall 240 may protrude downward from the bottom surface of the ice tray 210, while extending along the edge of the tray 210. Consequently, the first heat exchange prevention wall 240 may have an arrangement structure similar to that of the heater 230. However, the first heat exchange prevention wall 240 may be located more inwardly in relation to the ice tray 210 than the heater 230. Consequently, the heater 230 may be located outside the first heat exchange prevention wall 240. Meanwhile, as shown in FIG. 5, the cold air flow channel 225 is defined between opposite sides of the first heat exchange prevention wall 240. That is, the cold air may flow to the inside of the first heat exchange prevention wall 240 away from heater 230. As a result, heat exchange between the cold air and the heat emitted by the heater 230 may be prevented.

In other words, the cold air may flow along a central portion of the ice tray 210 in the longitudinal direction of the ice tray 210. The heater 230 may extend along the edge of the ice tray 210. The first heat exchange prevention wall 240 may be located between the central portion and the edge of the tray 210, whereby heat exchange between the heat emitted by the heater 230 and the cold air in the cold air flow channel 225 may be prevented.

Referring to FIG. 5, the second guide member 222 is provided with a pair of second heat exchange prevention walls 250 and 251. The second heat exchange prevention walls 250 and 251 may protrude upward from the upper surface of the second guide member 222 while extending along the edge of the ice tray 210 in the longitudinal direction of the ice tray 210. Unlike the heater 230 and the first heat exchange prevention wall 240, ends of the second heat exchange prevention walls 250 and 251 are not connected to each other. As a result, cold air may be introduced between the second heat exchange prevention walls 250 and 251.

As shown in FIG. 5, the heater 230 may be located outside the second heat exchange prevention walls 250 and 251, away from the cold air flow channel 225. The cold air may be introduced between the second heat exchange prevention walls 250 and 251 as described above. Consequently, heat exchange between the cold air and the heat emitted by the heater 230 may be prevented.

In addition, at least a portion (the lower end in this embodiment) of the first heat exchange prevention wall 240 and at least a portion (the upper end in this embodiment) of the second heat exchange prevention wall 250 may overlap each other in the lateral direction of the tray ice 210. As a result, the effect of heat exchange prevention may be further improved.

Meanwhile, a plurality of cooling ribs 400 may be provided at the bottom surface of the ice tray 210 thereof. The cooling ribs 400 may protrude downward while extending in the longitudinal direction of the ice tray 210. The cooling ribs 400 may increase the contact area between the ice tray 210 and the cold air, thereby improving cooling efficiency. The cooling ribs 400 may be spaced apart from each other in the lateral direction of the tray 210. Consequently, the cold air may flow between respective cooling ribs 400.

Figure 6:
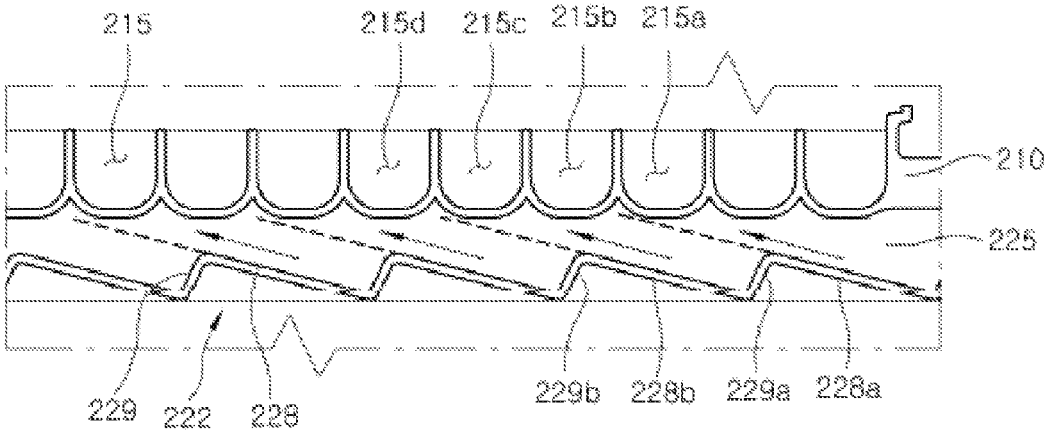
FIG. 6 is an enlarged view of a cold air flow channel shown in FIG. 2, in accordance with one embodiment of the present disclosure.

FIG. 6 is an enlarged view of the cold air flow channel 225 shown in FIG. 2, in accordance with one embodiment of the present disclosure. As shown, the second guide member 222 according to this embodiment may have an inclined structure for guiding cold air to the bottom surface of the tray 210. As a result, cooling speed may be increased, and therefore cooling efficiency may be improved.

The second guide member 222 may include a plurality of first inclined sections 228 and a plurality of second inclined sections 229. As shown in FIG. 6, the first inclined sections 228 and the second inclined sections 229 may be alternately arranged, in one embodiment.

Specifically, a first inclined section **228*a* may extend, while being inclined upward, in the longitudinal direction of the ice tray 210. Consequently, cold air flowing along the first inclined section 228*a* may move upward along the first inclined section 228*a* such that the cold air is directed to the bottom surface of the tray 210 in the direction of the arrows shown. In this embodiment, an imaginary extension line (dotted line) of the first inclined section 228*a* may reach between two ice making recesses 215*a* and 215*b* that are adjacent to each other in the longitudinal direction of the tray 210. In the same manner, an imaginary extension line of another first inclined section 228*b*, located to the left side of the first inclined section 228*a* while being spaced apart from the first inclined section 228*a*, may also reach between two ice making recesses 215*c* and 215*d* that are adjacent to each other in the longitudinal direction of the tray 210**.

That is, the imaginary extension line of the first inclined section **228*a* shown at the right most side in FIG. 6 may reach between the two adjacent ice making recesses 215*a* and 215*b*, and the imaginary extension line of the first inclined section 228*b*, shown to the left side of the first inclined section 228*a*, may reach between the two adjacent ice making recesses 215*c* and 215*d*. Consequently, the cold air may smoothly flow along the cold air flow channel 225, from right to left in FIG. 6, while contacting the bottom surface of the tray 210**, thereby increasing the cooling speed and thus improving the cooling efficiency.

A second inclined section 229*a* may be located between the two first inclined sections 228*a* and 228*b* that are spaced apart from each other in the longitudinal direction of the ice tray 210. For example, opposite ends of the second inclined section 229*a* may be connected to the two first inclined sections 228*a* and 228*b*. In addition, the second inclined section 229*a* may be inclined downward from the upper end of the first inclined section 228*a*, i.e. the highest point of the first inclined section 228*a*, in the longitudinal direction of the tray 210.

The second guide member 222 configured as described above has no even sections, in one embodiment. Consequently, the cold air may smoothly flow along the second guide member 222 while being prevented from flowing in whirls when passing the first inclined section 228*a*.

Figure 7:
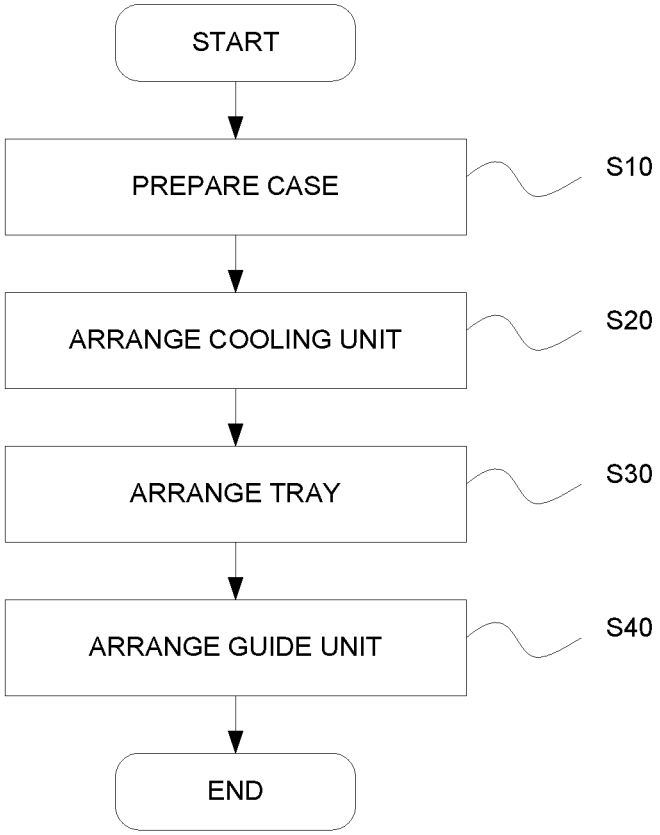
FIG. 7 is a flow diagram illustrating a method for manufacturing an ice maker, in accordance with one embodiment of the present disclosure.

FIG. 7 is a flow diagram illustrating a method of manufacturing the ice maker according to an embodiment of the present invention. The structures and features of the components of the ice maker 10 as described above in FIGS. 1-6 will now be described in relation to the flow diagram of FIG. 7.

First, the case 100 may be prepared (S10). The cooling unit, including the compressor, the condenser, the expansion valve, and the evaporator, which generates cold air, may be arranged to one side of the refrigerator unit 1 (S20). The ice tray 210, which includes ice making recesses 215 formed in the upper surface thereof for making ice, may be arranged in the case 100 (S30). Subsequently, the cold air guiding unit 220, which guides the cold air generated by the cooling unit to the lower side of the tray 210, may also be arranged in the case 100 (S40). As previously described, the second guide member 222 may include the first inclined sections 228. The first inclined sections 228 extend in the longitudinal direction, while being inclined upward, for guiding the cold air to the bottom surface of the tray 210. In addition, the imaginary extension line of each of the first inclined sections 228 may reach between the two ice making recesses 215 that are adjacent to each other in the longitudinal direction of the tray 210.

Thus, according to exemplary embodiments of the present invention, as is apparent from the above description, it may be possible to provide an ice maker of a refrigerator unit that is capable of preventing heat exchange between heat emitted by a heater and cold air, thereby improving overall efficiency, and a manufacturing method of the same. In addition, it may be possible to provide an ice maker of a refrigerator unit configured such that cold air is guided to an ice tray to increase cooling speed, and thus to improve cooling efficiency, and a manufacturing method of the same.

The foregoing description, for purpose of explanation, has been described with reference to specific embodiments of an ice maker and a method for deodorizing the same. However, the illustrative discussions above are not intended to be exhaustive or to limit the invention to the precise forms disclosed. It should be construed that the present invention has the widest range in compliance with the basic idea disclosed in the invention. Many modifications and variations are possible in view of the above teachings. Although it is possible for those skilled in the art to combine and substitute the disclosed embodiments to embody the other types that are not specifically disclosed in the invention, they do not depart from the scope of the present invention as well. The embodiments were chosen and described in order to best explain the principles of the invention and its practical applications, to thereby enable others skilled in the art to best utilize the invention. Further, it will be understood by those skilled in the art that various changes and modifications may be made without departing from the scope of the invention as defined in the following claims.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

Embodiments according to the invention are thus described. While the present disclosure has been described in particular embodiments, it should be appreciated that the invention should not be construed as limited by such embodiments.

What is claimed is:

1. An ice maker of a refrigerator comprising:

a cooling unit configured for generating cold air;

a case mounted in a food storage space of the refrigerator or a door configured for shielding the food storage space, the case having defined therein a cooling space configured for receiving the cold air generated by the cooling unit;

an ice making assembly configured for making ice; and a bucket arranged at one side of the ice making assembly configured for receiving the ice separated from the ice making assembly, wherein the ice making assembly comprises:

an ice tray arranged in the cooling space, the ice tray having a plurality of ice making recesses formed in an upper surface thereof configured for making ice; and a cold air guiding unit arranged at a lower side of the ice tray configured for guiding the cold air supplied from the cooling unit to the lower side of the ice tray, wherein the cold air guiding unit comprises a guide member spaced apart downward from a bottom surface of the ice tray, the cold air guiding unit configured for defining a cold air flow channel, along which the cold air flows, between the guide member and the bottom surface of the tray, the guide member comprising a first inclined section extending, while being inclined upward, in a longitudinal direction of the ice tray for guiding the cold air to the bottom surface of the tray, wherein an imaginary extension line of the first inclined section reaches between two of the ice making recesses that are adjacent to each other in the longitudinal direction of the tray, and wherein the guide member further comprises a second inclined section extending, while being inclined downward from a highest point of the first inclined section, in the longitudinal direction of the ice tray.

2. The ice maker according to claim 1, wherein:

the first inclined section comprises at least two first inclined sections provided in the longitudinal direction of the tray, the number of the ice making recesses is at least four, and an imaginary extension line of one of the at least two first inclined sections reaches between two of the at least four ice making recesses that are adjacent to each other, and an imaginary extension line of another of the at least two first inclined sections reaches between other two of the at least four ice making recesses that are adjacent to each other.

3. The ice maker according to claim 1, wherein the ice making assembly further comprises a heater provided at the lower side of the ice tray, wherein the heater is spatially separated from the guide unit, wherein the heater is configured for emitting heat to separate the ice from the ice making recesses.

4. The ice maker according to claim 3, wherein the heater is provided along an edge of the ice tray, and the cold air flows along a central portion of the ice tray in the longitudinal direction of the ice tray.

5. The ice maker according to claim 3, wherein:

the heater is provided along an edge of the tray, the ice maker further comprises a first heat exchange prevention wall protruding downward from the bottom surface of the ice tray while extending along the edge of the ice tray, the first heat exchange prevention wall being located more inwardly of the ice tray than the heater, and the cold air flows inside the first heat exchange prevention wall away from the heater.

6. The ice maker according to claim 5, further comprising a pair of second heat exchange prevention walls protruding upward from an upper surface of the guide member, while extending along the edge of the ice tray in the longitudinal direction of the ice tray, the second heat exchange prevention walls being spaced apart from each other in a lateral direction of the ice tray.

7. The ice maker according to claim 6, wherein:

the heater is located outside the second heat exchange prevention walls away from the cold air flow channel, and the cold air flows between the second heat exchange prevention walls in the cold air flow channel.

8. The ice maker according to claim 6, wherein:

the first heat exchange prevention wall is adjacent to the second heat exchange prevention walls, and at least a portion of the first heat exchange prevention wall and at least a portion of each of the second heat exchange prevention walls overlap each other in the lateral direction of the ice tray.

9. A method of manufacturing an ice maker of a refrigerator comprising:

preparing a case;

arranging a cooling unit configured for generating cold air;

arranging an ice tray having a plurality of ice making recesses formed in an upper surface thereof, the ice tray configured for making ice; and arranging a cold air guiding unit configured for guiding the cold air generated by the cooling unit to a lower side of the tray, wherein the cold air guiding unit comprises a guide member spaced apart downward from a bottom surface of the ice tray, and the cold air guiding unit is configured for defining a cold air flow channel, along which the cold air flows between the guide member and the bottom surface of the ice tray, the guide member comprising a first inclined section extending, while being inclined upward, in a longitudinal direction of the tray for guiding the cold air to the bottom surface of the ice tray, wherein an imaginary extension line of the first inclined section reaches between two of the ice making recesses that are adjacent to each other in the longitudinal direction of the tray, and wherein the guide member further comprises a second inclined section extending, while being inclined downward from a highest point of the first inclined section, in the longitudinal direction of the ice tray.

10. The method of claim 9, further comprising:

arranging a heater at the lower side of the ice tray, wherein the heater is spatially separated from the guide unit, wherein the heater is configured for emitting heat to separate the ice from the ice making recesses.

11. The method of claim 10, further comprising:

providing the heater along an edge of the ice tray, wherein the cold air flows along a central portion of the tray in the longitudinal direction of the tray.

12. The method of claim 10, further comprising:

providing the heater along an edge of the ice tray; and arranging a first heat exchange prevention wall protruding downward from the bottom surface of the ice tray, wherein the first heat exchange prevention wall is located more inwardly in relation to the ice tray than the heater;

wherein the cold air flows inside the first exchange prevention wall away from the heater.

13. The method of claim 12, further comprising:

arranging a pair of second heat exchange prevention walls protruding upward from an upper surface of the guide member while extending along the edge of the ice tray in the longitudinal direction of the ice tray, the second heat exchange prevention walls being spaced apart from each other in a lateral direction of the ice tray.

14. The method of claim 13, further comprising:

arranging the first heat exchange prevention wall adjacent to the second heat exchange prevention walls, wherein at least a portion of the first heat exchange prevention wall and at least a portion of each of the second heat exchange prevention walls overlap each other in the lateral direction of the ice tray.

15. A refrigerator, comprising:

a freezer chamber located within a main body of the refrigerator;

a refrigeration chamber located within the main body of the refrigerator;

a cooling unit configured for generating cold air;

a case mounted in a food storage space of the refrigerator or a door configured for shielding the food storage space, the case having defined therein a cooling space configured for receiving the cold air generated by the cooling unit;

an ice making assembly configured for making ice; and a bucket arranged at one side of the ice making assembly configured for receiving the ice separated from the ice making assembly, wherein the ice making assembly comprises:

an ice tray arranged in the cooling space, the ice tray having a plurality of ice making recesses formed in an upper surface thereof configured for making ice; and a cold air guiding unit arranged at a lower side of the ice tray configured for guiding the cold air supplied from the cooling unit to the lower side of the ice tray, the cold air guiding unit comprising a guide member spaced apart downward from a bottom surface of the ice tray, the cold air guiding unit configured for defining a cold air flow channel, along which the cold air flows, between the guide member and the bottom surface of the tray, the guide member comprising a first inclined section extending, while being inclined upward, in a longitudinal direction of the ice tray for guiding the cold air to the bottom surface of the tray, wherein an imaginary extension line of the first inclined section reaches between two of the ice making recesses that are adjacent to each other in the longitudinal direction of the tray, and wherein the guide member further comprises a second inclined section extending, while being inclined downward from a highest point of the first inclined section, in the longitudinal direction of the ice tray.

16. The refrigerator of claim 15, wherein:

the first inclined section comprises at least two first inclined sections provided in the longitudinal direction of the tray, the number of the ice making recesses is at least four, and an imaginary extension line of one of the at least two first inclined sections reaches between two of the at least four ice making recesses that are adjacent to each other, and an imaginary extension line of another of the at least two first inclined sections reaches between other two of the at least four ice making recesses that are adjacent to each other.

17. The refrigerator of claim 15, wherein the ice making assembly further comprises a heater provided at the lower side of the ice tray, wherein the heater is spatially separated from the guide unit, wherein the heater is configured for emitting heat to separate the ice from the ice making recesses.

18. The refrigerator of claim 17, wherein the heater is provided along an edge of the tray, wherein the ice maker further comprises a first heat exchange prevention wall protruding downward from the bottom surface of the ice tray while extending along the edge of the ice tray, the first heat exchange prevention wall being located more inwardly of the ice tray than the heater, and wherein the cold air flows inside the first heat exchange prevention wall away from the heater; and further comprising a pair of second heat exchange prevention walls protruding upward from an upper surface of the guide member, while extending along the edge of the ice tray in the longitudinal direction of the ice tray, the second heat exchange prevention walls being spaced apart from each other in a lateral direction of the ice tray.

* * * * *